United States Patent [19]

Sato et al.

[11] Patent Number: 4,840,740

[45] Date of Patent: Jun. 20, 1989

[54] GREASE FOR HOMOKINETIC JOINT

[75] Inventors: Tasuku Sato; Kiyoshi Nakanishi; Yoshikazu Fukumura; Keizo Nagasawa, all of Iwata, Japan

[73] Assignee: NTN Toyo Bearing Co., Ltd., Osaka, Japan

[21] Appl. No.: 233,862

[22] Filed: Aug. 17, 1988

Related U.S. Application Data

[63] Continuation of Ser.. No. 3,172, Jan. 14, 1987, abandoned.

[30] Foreign Application Priority Data

Jan. 16, 1986 [JP] Japan ..... 61-8432
Apr. 25, 1986 [JP] Japan ..... 61-97615
Oct. 20, 1986 [JP] Japan ..... 61-250417

[51] Int. Cl.[4] ..... C10M 137/10; C10M 115/08

[52] U.S. Cl. ..... 252/32.7 E; 252/464; 252/51.5 A

[58] Field of Search ..... 252/32.7 E, 46.4, 51.5 A

[56] References Cited

U.S. PATENT DOCUMENTS 3,203,897 8/1965 Ambrose ..... 252/32.7 E
3,300,409 1/1967 Butler ..... 252/32.7 E
3,360,463 12/1967 Jacques ..... 252/32.7 E
3,400,140 9/1968 Rowan ..... 252/32.7 E
3,840,463 10/1974 Froeschmann ..... 252/32.7 E
3,925,213 12/1975 Froeschmann ..... 252/32.7 E
4,370,245 1/1983 Ryu ..... 252/46.4
4,383,931 5/1983 Ryu ..... 252/32.7 E
4,392,966 7/1983 Schlicht ..... 252/32.7 E
4,551,258 11/1985 Ikeda ..... 252/32.7 E

FOREIGN PATENT DOCUMENTS 1089463 11/1967 United Kingdom ..... 252/32.7 E
1136723 12/1968 United Kingdom ..... 252/32.7 E
2185492 7/1987 United Kingdom .

*Primary Examiner*—William R. Dixon, Jr.
*Assistant Examiner*—Jerry D. Johnson
*Attorney, Agent, or Firm*—Armstrong, Nikaido, Marmelstein, Kubovcik & Murray

[57] ABSTRACT

Improved greases for use in homokinetic joints are proposed which comprise a base oil, a thickening agent, and an organic molybdenum compound. Greases comprising a base oil, a thickening agent, an organic molybdenum compound, and an organic zinc compound are also proposed. These greases exhibit smaller friction coefficients than conventional greases used for this purpose. On the homokinetic joint lubricated with the grease according to the present invention, the axial force produced is reduced and vibrations generated on the engine are absorbed. The vehicle is prevented from vibrating. The use of an expensive organic metallic extreme-pressure additive is unnecessary.

8 Claims, 6 Drawing Sheets

GREASE FOR HOMOKINETIC JOINT

This application is a continuation of application Ser. No. 003,172 filed Jan. 14, 1987 abandoned.

This invention relates to greases for a homokinetic joint, particularly for a plunging type homokinetic joint.

Among plunging type homokinetic joints, a double offset type homokinetic joint and a tripod type homokinetic joint are known.

As shown in FIG. 1, the double offset type homokinetic joint has an outer race 1 formed with six axial track grooves 3 in its inner surface, an inner race 2 formed with six axial track grooves 4 in its outer surface, these grooves being spaced at equal angular intervals, balls 5 disposed between the inner race 1 and the outer race 2, and a cage 6 retaining the balls 5. The cage 6 has an outer spherical surface 7 and an inner spherical surface 8 adapted to fit the outer periphery of the inner race 2. The centers (a) and (b) of the spherical surfaces 7 and 8 are on the axis of the outer race 1 and are apart from each other in an axial direction.

As shown in FIG. 2, the tripod type homokinetic joint is provided with an outer race 11 formed with three axial cylindrical track grooves 12 in its inner surface at equal angular intervals. A tripod member 13 provided with three trunnions 14 is mounted in the outer race 11. A spherical roller 15 is mounted on each trunnion 14 with needles 16 fitted between the spherical roller 15 and the trunnion 14 to support the spherical roller 15 rotatably and axially slidably. The spherical rollers 15 are received in the track grooves 12.

On the double offset type joint, the revolution torque is transmitted by engagement between the balls 5 and the outer race 1 and between the balls 5 and the inner race 2. On the tripod type joint, the torque is transmitted by engagement between the spherical rollers 15 and the outer race 11. The balls 5 and the spherical rollers 15 roll along the track grooves 3 and 12, respectively, for smooth plunging.

When the revolution torque is transmitted with the joint forming a working angle, rolling and sliding occur between the balls 5 and the outer race 1 and between the balls 5 and the inner race 2, and sliding occurs between the cage 6 and the outer race 1 and between the cage 6 and the inner race 2 on the double offset type homokinetic joint. On the other hand, rolling and sliding occur between the outer race 11 and the spherical rollers 15 on the tripod type homokinetic joint.

Thus, on the plunging type homokinetic joint, the element of sliding is more dominant than the element of rolling. When the revolution torque is transmitted with the joint forming a working angle, the frictional resistance produced at the sliding portions produces an axial force.

On the double offset type homokinetic joint, since the track grooves 3 are formed in the inner surface of the outer race 1 at an equal interval of 60 degrees, axial forces are produced six times per revolution as shown in FIG. 3. On the tripod type homokinetic joint, since the track grooves 12 are formed at an equal interval of 120 degrees, axial forces are produced three times per revolution as shown in FIG. 4.

If the cycle of generation of the axial force coincides with the natural frequencies of the engine, body, suspension, etc., resonance will be induced in the vehicle body, giving passengers discomfort. Therefore, it is desirable to reduce the axial forces as low as possible.

It is customary to fill the inside of the plunging type homokinetic joint with a lubricant to decrease the frictional resistance and improve the slidability. A grease containing molybdenum disulfide as a solid lubricant has been used for this purpose. But, with a vehicle equipped with a tripod type homokinetic joint filled with the grease, rolling occurs during acceleration, whereas with a vehicle equipped with a double offset type homokinetic joint filled with the grease, beating noise or muffled noise produce and the vehicle body is apt to vibrate while running at a high speed.

On the plunging type homokinetic joint, the axial force is produced, causing the vehicle body to vibrate as described above. It is thought that in spite of the fact that the sliding portions of the joint are supplied with a grease, there still develops a substantial frictional resistance at the sliding portions, and that if the frequency of the axial force generated in the joint coincides with the vibration of the engine, the vehicle body will vibrate. It is also thought that the joint functions as a medium of transmitting vibrations which have generated in the engine. This phenomenon is often observed during idling on an automatic transmission vehicle.

An object of the present invention is to provide a grease which has a low coefficient of friction enough to keep the vehicle body from rolling or producing beating noise or muffled noise while the vehicle is accelerating or running at a high speed.

From one aspect of the present invention, there is provided a grease for a homokinetic joint comprising a base oil, a thickening agent and an organic molybdenum compound. From another aspect of the present invention, there is provided a grease for a homokinetic joint comprising a base oil, a thickening agent, an organic molybdenum compound and an organic zinc compound.

The grease for a homokinetic joint according to the present invention is a grease which has a smaller friction coefficient than a conventional grease containing molybdenum dithiocarbamate. The use of the grease as a lubricant for a homokinetic joint decreases the axial force and absorbs vibrations generated in the engine, and prevents the vehicle body from vibrating. Furthermore, this grease is less expensive because it has only to contain such an organic molybdenum compound as molybdenum dithiophosphate and such an organic zinc compound as zinc dithiophosphate without the need of using various kinds of costly organic metallic extreme-pressure additives used in a conventional grease.

Other objects and features of the present invention will become apparent from the following description taken with reference to the accompanying drawings, in which.

Figure 1:
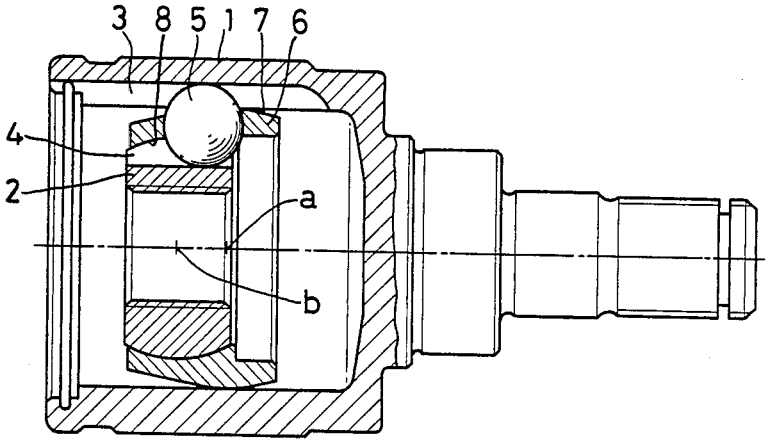
FIG. 1 is a partially cutaway view in section of a double offset type homokinetic joint.

The base oil according to the present invention may be a mineral oil or a synthetic hydrocarbon oil having a viscosity of lubricant. As a thickening agent, urea compounds (such as monourea, diurea and polyurea) which have a higher heat resistance than such metallic soap as lithium soap are preferable. This is because a homokinetic joint is usually arranged under relatively high-temperature atmosphere near the engine and the joint itself tends to heat up and get hot while transmitting a revolution torque.

It is preferable to add a lead soap such as lead naphthenate, zinc diaryl dithiophosphate or zinc dialkyl dithiophosphate to the grease to increase an anti-oxidant effect as well as an extreme-pressure effect.

Organic molybdenum compounds used in the present invention may be molybdenum dialkyl dithiocarbamate, molybdenum dialkyl dithiophosphate or molybdenum diaryl dithiophosphate, i.e., compounds of the following structural formula:

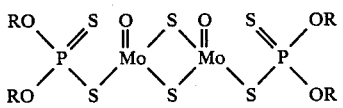

wherein R represents a primary or secondary alkyl group or aryl group.

The organic molybdenum compound may be a single compound or a mixture of two or more compounds.

The content of the organic molybdenum compound should be 10 percent by weight or less, preferably 3–5 percent by weight or less. The excessive amount will have only the same effect or lessen the effect.

The organic zinc compound used in the present invention may be zinc dialkyl dithiophosphate or zinc diaryl dithiophosphate of the following structural formula:

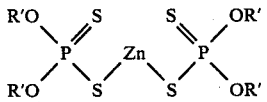

wherein R' represents a primary or secondary alkyl group or aryl group.

The organic zinc compound may be a single compound or a mixture of two or more compounds.

Such organic zinc compounds as well as such organic molybdenum compounds are extremely effective extreme-pressure additives. The content should be 15 percent by weight or less, preferably 5–6 percent by weight or less. Any excessive amount brings about only the same effect or lessens the effect. If an organic molybdenum compound coexists with an organic zinc compound, they will produce an excellent effect even if the contents are less. In this case, the content of each compound should be 0.5–5.0 percent by weight.

An antioxidant or a detergent-dispersant may be added in addition to the extreme-pressure additive.

Organic molybdenum compounds are fundamentally different from such conventional solid lubricants as molybdenum disulfide. It does not exhibit a lubricating effect so much before being decomposed. It transforms itself into such a lubricating material as molybdenum disulfide only after it is decomposed by the frictional heat generated on the sliding face. Molybdenum dialkyl dithiocarbamate (hereinafter abbreviated to Mo-DTC) and molybdenum diaryl dithiophosphate (hereinafter abbreviated to Mo-DTP) were selected from among organic molybdenum compounds and their heat-decomposition temperatures were measured by the differential thermal analysis. The analysis shows that the heat-decomposition temperature of Mo-DTC is 252°–312° C. whereas that of Mo-DTP is 145°–225° C. The heat-decomposition starting temperature for the latter is lower by approximately 100° C. than that for the former. This indicates that Mo-DTP is transformed into a lubricating material on the sliding surface earlier than Mo-DTC, and acts as a good extreme-pressure additive. Thus, molybdenum dithiophosphate can be said to be a far better organic molybdenum compound than molybdenum dithiocarbamate.

But, a significant decrease in friction coefficient cannot be expected by the addition of a kind of such compound. When zinc dialkyl dithiophosphate or zinc diaryl dithiophosphate (hereinafter abbreviated to Zn-DTP) is further added, the friction coefficient substantially decreases.

The results of these experiments are shown in Table 1. This shows that a urea compound is preferable to a metallic soap such as lithium soap as a thickening agent. It is presumed that a synergetic effect is produced when Mo-DTP and Zn-DTP are used in combination because Zn-DTP acts as a catalyst for heat-decomposition of Mo-DTP.

TABLE 1

| Experiment No. | Composition of Grease | Friction coefficient |
|---|---|---|
| 1 | Mineral oil + Polyurea | 0.103~0.104 |
| 2 | Mineral oil + Polyurea + Mo—DTP | 0.098~0.100 |
| 3 | Mineral oil + Polyurea + Mo—DTP + Zn—DTP | 0.037~0.040 |
| 4 | Mineral oil + Lithium soap + Mo—DTP + Zn—DTP | 0.081~0.091 |

EXAMPLE 1

Figure 2:
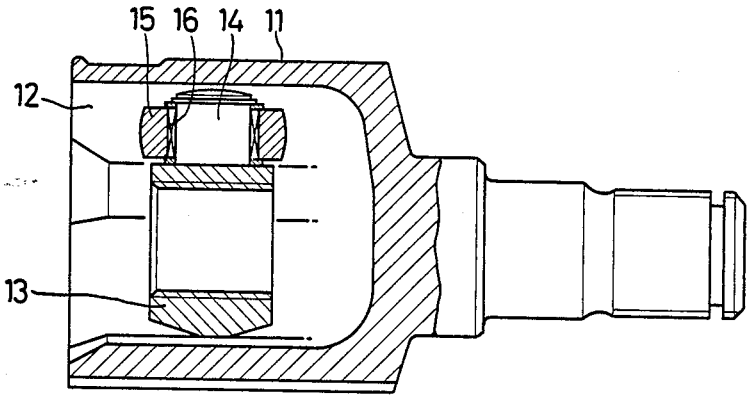
FIG. 2 is a partially cutaway view in section of a tripod type homokinetic joint.
Figure 3:
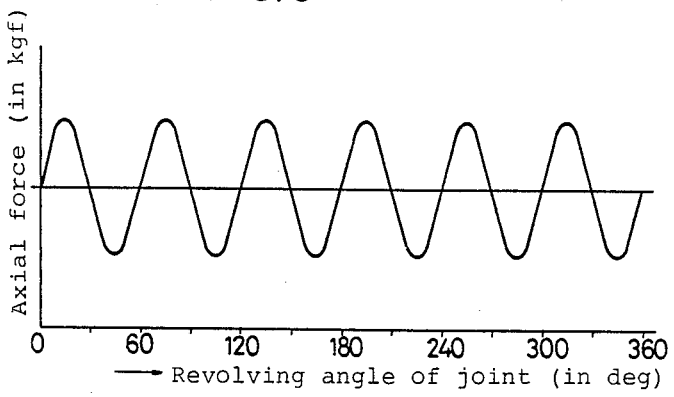
FIGS. 3 and 4 are graphs showing the relation between the axial force and the revolving angle of the joint in FIGS. 1 and 2, respectively.
Figure 4:
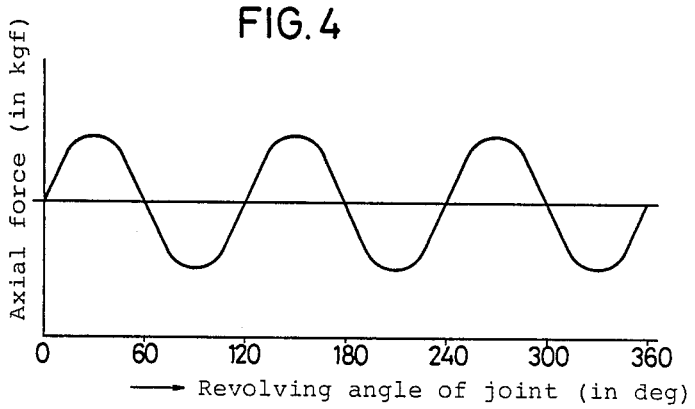

On the plunging type homokinetic joint shown in FIGS. 1 and 2, the axial force produced on the shaft when the joint transmits a revolution torque forming a working angle is thought to be an induced thrust, and the vibration occurring on an automatic transmission vehicle during idling is thought to be caused by the slide resistance of the joint.

The induced thrust is defined to be an axial force produced when a revolution torque is applied with a working angle formed without allowing the driving shaft and the driven shaft to slide axially. The slide resistance is defined to be a resistance generated when one of the driving and driven shafts is excited axially with the other fixed.

Figure 5:
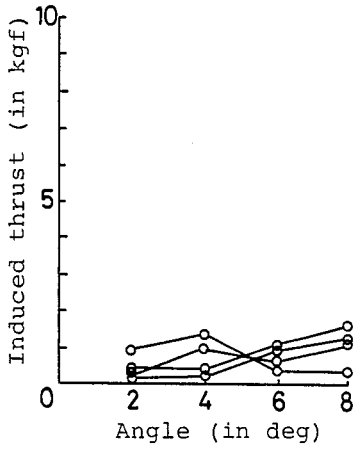
FIG. 5 is a graph showing the relation between the induced thrust and the angle on a double offset type homokinetic joint in which Specimen A is used as a lubricant.
Figure 6:
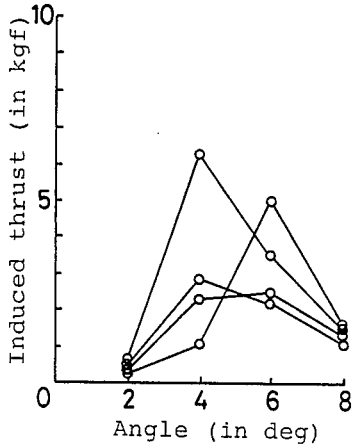
FIG. 6 is a similar graph showing the relation between the induced thrust and the angle on a homokinetic joint filled with a commercially available grease.

Two specimens (hereinafter referred to as Specimen A and Specimen A') according to the present invention and three more specimens I, II and III (greases commercially available and generally used) were put separately in the double offset type homokinetic joints shown in FIG. 1 and the induced thrust was measured for these specimens. The properties of the specimens are shown in Table 2. The results of measurements after 5 minutes from the start of operation are shown in FIGS. 5 and 6. The slide resistance was measured at the same time. The results of measurements are shown in FIGS. 7 and 8.

Figure 7A:
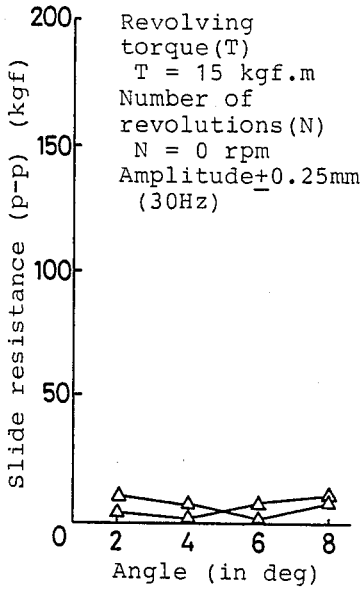
FIG. 7 is graphs showing the relation between the slide resistance and the angle on a homokinetic joint in which Specimen A is used as a lubricant.
Figure 7B:
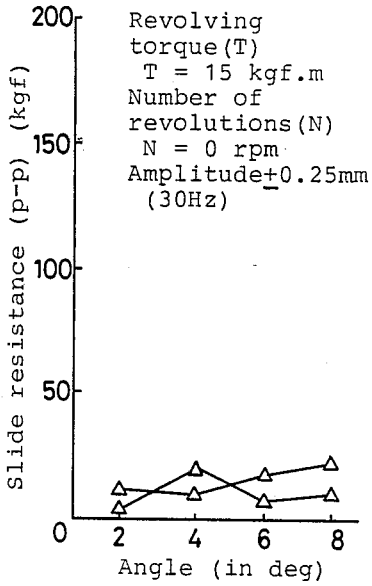
Figure 7C:
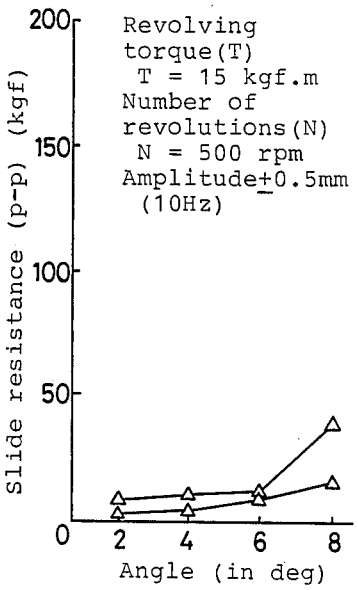

FIGS. 5 and 7 show the results of measurements for Specimen A. The results of measurements for Specimen A' are omitted because the results are virtually the same as for Specimen A. FIGS. 6 and 8 show the results of measurements for Specimen II. The results of measurements for Specimens I and III are omitted because they are almost the same as for Specimen II.

Figure 8A:
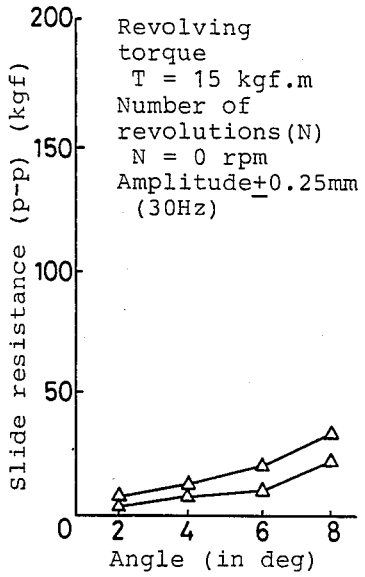
FIG. 8 is graphs showing the relation between the slide resistance and the angle on a homokinetic joint in which a commercially available grease is used.
Figure 8B:
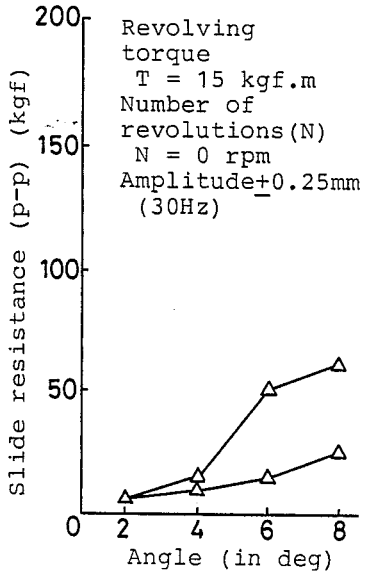
Figure 8C:
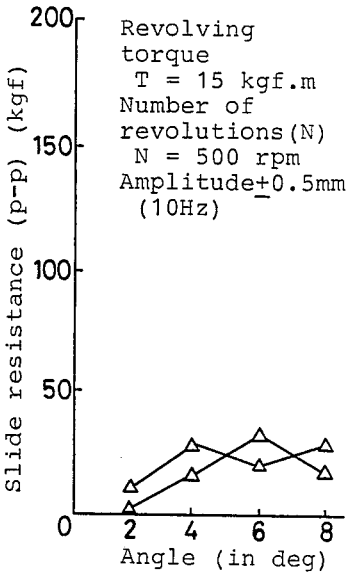

Referring to FIGS. 7 and 8, (a) indicates the slide resistance measured soon after the excitation, (b) does the one measured 5 minutes after the excitation, and (c) does the one when the homokinetic joint was rotating at 500 rpm. The slide resistance is indicated in terms of the sum (peak-to-peak value) of the maximum value and the minimum value.

As will be seen from the results of measurements shown in FIGS. 5 through 8, the induced thrust and the slide resistance are smaller for the joint lubricated with Specimen A than the one lubricated with Specimen II.

CHECK EXPERIMENT 1

Figure 9:
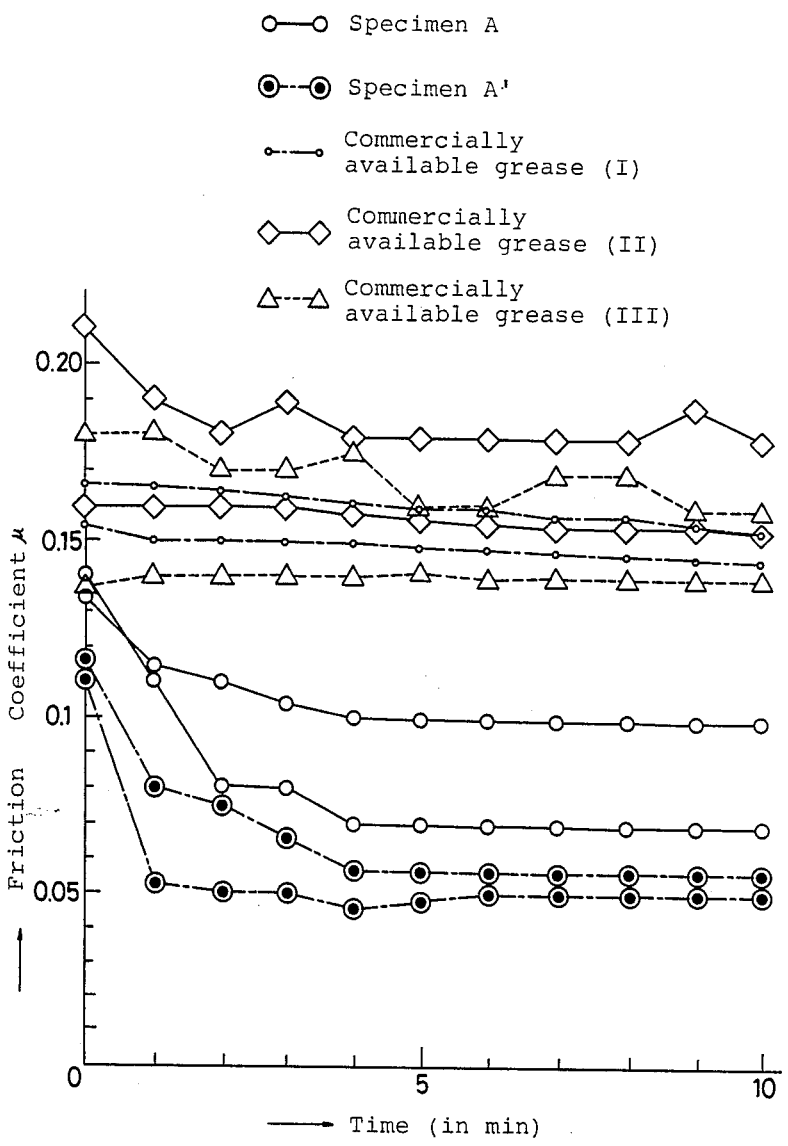
FIG. 9 is a graph showing the variation of friction coefficient with time for Specimens A and A' and commercially available greases.
Figure 10:
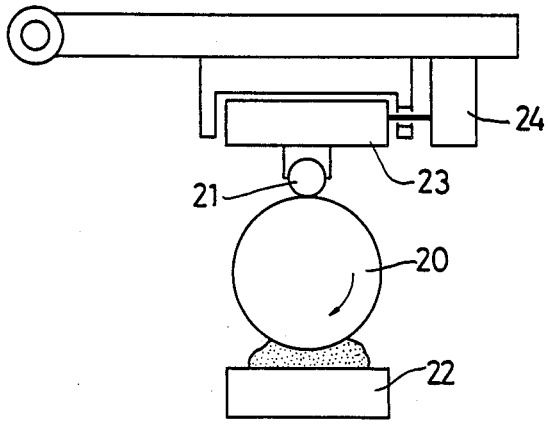
FIG. 10 is a schematic view of a Sawin type wear tester.

The friction coefficient of each grease specimen shown in Table 2 was measured using a Sawin type wear tester. The results are shown in FIG. 9. In the Sawin type wear tester, a $\frac{1}{4}''$ steel ball 21 is arranged in contact with a rotary ring 20 (40 mm dia×4 mm), as shown in FIG. 10. The surface roughness of the ring 20 in the width direction is 1.6–1.9 S and the one in the axial direction is 0.4–0.6 S. In measuring the friction coefficient of the grease specimens, the rotary ring 20 was revolved at a peripheral speed of 108 meter per minute under a load of 1 kgf. Each grease was supplied to the surface of the rotary ring 20 from its lower end through a sponge 22 and the movement of an air slide 23 supporting the steel ball 21 was sensed by a load cell 24.

As is apparent from the results shown in FIG. 9, the friction coefficients of Specimen A and Specimen A' are smaller than those of commercially available greases I, II and III, and particularly Specimen A' containing molybdenum dialkyl dithiocarbamate and molybdenum dialkyl dithiophosphate has an extremely small friction coefficient. After the measurements, the surface of the steel ball was observed under a microscope. This revealed that the size of the wear scars formed corresponds to the friction coefficient of the grease used. Namely, the smaller the friction coefficient of grease, the smaller the size of the wear scars formed was.

CHECK EXPERIMENT 2

The Sawin type wear tester was used to measure the friction coefficients with the change in load (or surface pressure) for Specimen A, commercially available greases II and III. The results are shown in FIG. 11.

Figure 11:
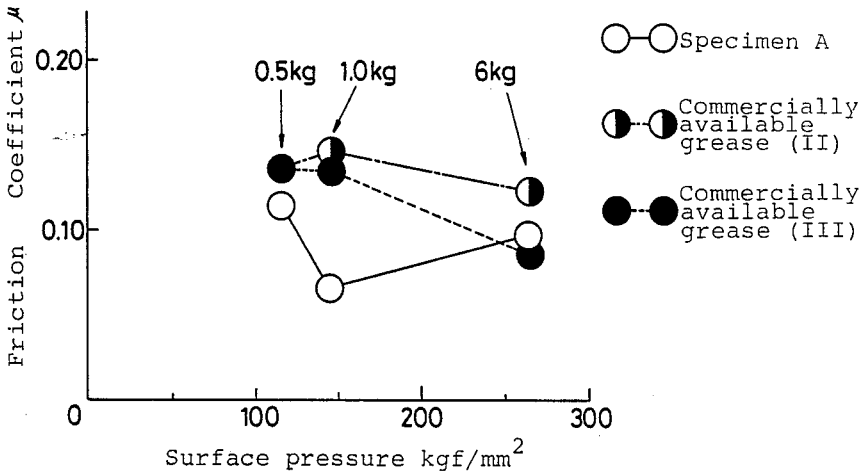
FIG. 11 is a graph showing the relation between the friction coefficient and the load for Specimen A and commercially available greases.

As seen from FIG. 11, the influence of the load on the friction coefficient differs among the specimens tested. For the commercially available greases II and III, the friction coefficient tends to gradually decrease with the increase in the load, whereas for Specimen A there is the minimum point. It is thought to be due to the difference in additives that Specimen A has a different tendency from the other specimens. It is thought that the organic molybdenum compound mixed in Specimen A is decomposed by heat at the sliding surface and the products by the decomposition adhere to the sliding surface, displaying their effects.

It is thought that Specimen A displays excellent frictional properties shown in Example 1 because the working conditions on a homokinetic joint produce conditions suitable for the organic molybdenum to readily decompose.

CHECK EXPERIMENT 3

Specimen A and commercially available grease II shown in Table 2 were put in homokinetic joints shown in FIG. 1, which underwent a continuous operation for 125 hours under the conditions of a revolution torque T=23.5 kg.f-m, a number of revolutions N=1750 rpm, working angle $\theta=11.6°$ and cooling air rate of about 30 km/h to observe how the track groove surface peels. The results are shown in Table 3, from which it is apparent that peeling barely happened on the homokinetic joint on which Specimen A was used as a lubricant.

CHECK EXPERIMENT 4

The Sawin type wear tester shown in FIG. 10 was used to measure the friction coefficient for each specimen. The results are shown in Table 3. Measurement conditions were: peripheral speed: 108 meter/min. load: 1 kgf.

As is apparent from Table 4, the inclusion of organic molybdenum lowered the friction coefficient, and the addition of zinc diaryl dithiophostate or zinc dialkyl dithiophostate further lowered the friction coefficient.

EXAMPLE 2

In order to confirm the results of Example 1, the following greases according to the present invention were prepared by use of organic molybdenum compounds and organic zinc compounds. For any grease herein prepared, a mineral oil containing a polyurea thickening agent was used.

(1) grease containing 3% of molybdenum diaryl dithiophosphate [made by ASAHI DENKA KOGYO K.K.: SAKURA-LUBE 300] and 2% of zinc dialkyl (primary) dithiophosphate [made by NIPPON LUBRIZOL INDUSTRIES CORP.: LUBRIZOL 1097]

(2) grease containing 3% of molybdenum diaryl dithiophosphate [made by VANDERBILT EXPORT CORPORATION: MOLYVAN L] and 1.2% of zinc dialkyl (secondary) dithiophosphate [made by NIPPON LUBRIZOL INDUSTRIES CORP.: LUBRIZOL 1095]

(3) grease containing 3% of molybdenum diaryl dithiophosphate [MOLYVAN L] and 1% of zinc diaryl dithiophosphate [made by NIPPON LUBRIZOL INDUSTRIES CORP.: LUBRIZOL [1370]

The friction coefficients of three kinds of greases prepared were measured by use of the Sawin type wear tester. The results obtained are listed in Table 5. For comparison with the greases according to the present invention, the following three kinds of greases (a)–(c) were prepared as controls and the friction coefficients were measured in the same manner as above. The results are also listed in Table 5. The base oil used for (a) is the same mineral oil containing a polyurea thickening agent as used for the greases (1)–(3). For (b), a mineral oil containing a thickening agent in lithium soap series instead of a polyurea thickening agent.

(a) grease containing 3% of molybdenum diaryl dithiophosphate [made by ASAHI DENKA KOGYO K.K.: SAKURA LUBE 300] only and not containing any organic zinc compounds.

(b) grease containing 3% of the same molybdenum diaryl dithiophosphate as used for (a) [SAKURA LUBE 300], and 3% of zinc dialkyl (secondary) dithiophophate [LUBRIZOL 1097]

(c) grease containing molybdenum dialkyl dithiocarbamate.

As seen from Table 5, the coexistence of an organic molybdenum compound and an organic zinc compound is preferable, and as a thickening agent, an urea compound is much more preferable than lithium soap.

TABLE 2

| Ingredient | | Specimen | | | | |
|---|---|---|---|---|---|---|
| | | | | Commercially available grease | | |
| | | Specimen A | Specimen A' | I | II | III |
| Thickening agent | | Polyurea | Polyurea | Lithium soap | Lithium soap | Lithium soap |
| Additive | Molybdenum compound | Molybdenum dialkyl dithiocarbamate 3% | Molybdenum dialkyl dithiocarbamate 3% Molybdenum dialkyl dithiophosphate 3% | Molybdenum disulfide 1.5% | Molybdenum disulfide 1.5% | None |
| | Extreme-pressure agent | Pb series Zn series | Pb series Zn series | S-P series P series | S-P series P series | S-P series |
| Base oil | | Mixture of Paraffin and Naphthene series | Mixture of Paraffin and Naphthene series | Paraffin series | Mixture of Paraffin and Naphthene series | Naphthene series |
| Viscosity of Base oil (cst) | | | | | | |
| 40° C. | | 212.9 | 212.9 | 173.0 | 228 | — |
| 100° C. | | 15.6 | 15.6 | 14.90 | 15.7 | 14.5 |
| VI | | 66 | 66 | 81.0 | 89 | 85 |
| Consistency 25° C. 60 W | | 283 | 292 | 283 | 270 | 279 |
| Work stability ($10^5$ W) | | 326 | — | 341 | 290 | 334 |
| On a Shell 4-ball machine limit load in kg | | 126 | — | 100 | 100 | 126 |

TABLE 3

| Specimen | | Surface temperature of outer race of double offset type homokinetic joint (°C.) (100 / 150 / 200) | Condition of the joint after test: Outer race | Inner race | Ball |
|---|---|---|---|---|---|
| Commercially available grease II | 1 | | 6/6 F | 6/6 F | 5/6 F |
| | 2 | | 6/6 F | 5/6 F | 5/6 F |
| | 3 | | 4/6 F | 5/6 F | 4/6 F |
| Specimen of this invention | 1 | | o | o | o |
| | 2 | | o | o | o |
| | 3 | | o | o | o |
| | 4 | | 3/6 F | o | o |

Temperature:
Max. value at initial stage
— Between 50~100 hrs.
— Between 100~125 hrs.
Joint condition:
4/6 F . . . Peeling observed on 4 tracks out of 6 tracks
o . . . No peeling observed.

TABLE 4

| Specimen | Base oil | Thickening agent | Extreme pressure agent | Friction coefficient |
|---|---|---|---|---|
| No. 1 | Mineral oil | Polyurea | None | 0.14 |
| No. 2 | | | Molybdenum dialkyl dithiophosphate | 0.08~0.009 |
| No. 3 | | | Molybdenum dialkyl dithiophosphate Zinc diaryl dithiophosphate | 0.08 |
| No. 4 | | | Molybdenum dialkyl dithiophosphate Zinc dialkyl dithiophosphate | 0.05 |

TABLE 5

| Grease No. | Friction coefficient |
|---|---|
| (1) | 0.037~0.040 |
| (2) | 0.041~0.047 |
| (3) | 0.037~0.038 |
| Controls | |
| (a) | 0.098~0.100 |
| (b) | 0.081~0.091 |
| (c) | 0.055~0.085 |

What is claimed:

1. A grease for a homokinetic joint comprising a base oil, a thickening agent which is a urea compound and an organic molybdenum compound, in an amount of up to 10% by weight, selected from at least one compound from the group consisting of molybdenum dialkyl dithiocarbamate, molybdenum dialkyl dithiophosphate and molybdenum diaryl dithiophosphate of the formula:

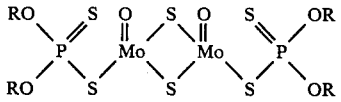

wherein R represents a primary or secondary alkyl group or aryl group and an organic zinc compound selected from the group consisting of zinc dialkyl dithiophosphate, and zinc diaryl dithiophosphate of the formula:

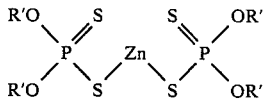

wherein R′ represents a primary or secondary alkyl or aryl group, in an amount of up to 15% by weight.

2. A grease as claimed in claim 1, wherein said organic molybdenum compound is two or more selected from the group consisting of molybdenum dialkyl dithiocarbamate, molybdenum dialkyl dithiophosphate and molybdenum diaryl dithiophospate.

3. A grease as claimed in claim 1, wherein both the content of said organic molybdenum compound and that of said organic zinc compound are 0.5 to 5.0 percent by weight.

4. The grease for a homokinetic joint of claim 1, wherein the organic molybdenum compound comprises molybdenum dialkyl dithiocarbamate.

5. The grease for a homokinetic joint of claim 1, wherein the organic molybdenum compound comprises molybdenum dialkyl dithiophosphate.

6. The grease for a homokinetic joint of claim 1, wherein the organic molybdenum compound comprises molybdenum diaryl dithiophosphate.

7. The grease for a homokinetic joint of claim 1, wherein the organic molybdenum compound comprises molybdenum dialkyl dithiocarbamate and molybdenum dialkyl dithiophosphate.

8. The grease for a homokinetic joint of claim 1, wherein the organic molybdenum compound comprises molybdenum dialkyl dithiocarbamate and molybdenum diaryl dithiophosphate.

* * * * *